US005943976A

United States Patent [19]

Bakker

[11] Patent Number: 5,943,976

[45] Date of Patent: Aug. 31, 1999

[54] LOCKABLE STORAGE COVER AND SPAR LOCK FOR SMALL CRAFT

[76] Inventor: Erik Herrmann Bakker, 3315 Falcon Ave., Signal Hill, Calif. 90807

[21] Appl. No.: 08/940,795

[22] Filed: Sep. 30, 1997

[51] Int. Cl.[6] ..... B63B 19/12; B63B 17/00

[52] U.S. Cl. ..... 114/201 R; 114/361

[58] Field of Search ..... 114/173, 201, 114/201 R, 364, 39.1, 116, 343, 361, 203; 224/406; 211/60.1, 70.5, 70.8; 292/101, 102, 202, 203, 210

[56] References Cited

U.S. PATENT DOCUMENTS

| | | | |
|---|---|---|---|
| 3,956,785 | 5/1976 | Halfon | 114/39 |
| 4,194,458 | 3/1980 | Messing | 114/39 |
| 4,928,615 | 5/1990 | Williams | 114/203 |
| 5,005,509 | 4/1991 | Williams | 114/343 |

*Primary Examiner*—Sherman Basinger
*Assistant Examiner*—Patrick Muldoon
*Attorney, Agent, or Firm*—Fulwider Patton Lee & Utecht, LLP

[57] ABSTRACT

A lockable storage cover is a single-unit which may be used to contain and safely lock down gear commonly used with smaller boats, and to form, in conjunction with a space on the boat, a storage locker. The lockable storage cover is designed for use with any small boat having an opening, especially a cockpit opening, in any situation where an operator has a need to secure and lock his/her sailing gear, either for reasons of convenience, theft deterrent, or shipping. Smaller gear such as a rudder and tiller and tiller extension are secured to the underside of cover, the cover is placed over a center cockpit of a boat and may be locked, enclosing the smaller gear within the cockpit and transforming the cockpit into a storage locker. Spars may be placed in the set of spar supports atop the lockable storage cover and secured by one or more moveable arms which may be locked in place and which doubles as a kickstand on which to prop the lockable storage cover for convenience. The storage cover is preferably made of molded plastic for economy of production, durability, low weight, and water resistance.

19 Claims, 7 Drawing Sheets

LOCKABLE STORAGE COVER AND SPAR LOCK FOR SMALL CRAFT

FIELD OF THE INVENTION

The present invention relates to the field of storage covers, and more specifically to a lockable storage cover for a small boat, such as the one sold under the trademark LASER, which helps to eliminate the need to hand-carry or otherwise store items such as spars, a tiller/tiller extension, rudder, or dagger board, life jacket, hiking boots, sails, lines etc., while a boat operator is en route to operate such a boat, or while a boat is in storage at a marina or similar facility.

BACKGROUND OF THE INVENTION

Currently, very few options are available for safe carrying and/or storage of components such as the spars, tiller and its tiller extension, rudder, or dagger board, or sail, lines, life jacket, blocks, etc. which are commonly used on small boats. Boats of the small size and simple hull type, such as those sold under the trademark LASER are frequently used in competitions which require travel away from home on the part of a boat operator.

This type of boat has an upper portion generally continuous with the upper portions of the hull except for a central open area referred to as a cockpit. During operation, the cockpit provides a space for the operator's legs, as the operator sits on the side top surface of the craft on either side of the cockpit.

These types of boats are often used recreationally, as well as in sailing competition, both of which may also involve travel on the part of a boat operator. Typically, although a boat operator may send his boat to a chosen location by some way of shipping, he or she is inhibited from shipping the smaller, more delicate boat gear for fear of damage or theft, either of which may be inconvenient and expensive. Because of the risks inherent in shipping the smaller boat components, boat operators are usually obligated to hand-carry the components to their destination. If air travel is the method of transportation used to reach the boat owner's destination, this may require physically transporting the bulky but somewhat delicate boat components through an airport, then struggling to find a compartment on the aircraft in which the equipment may be safely stored for a flight. Current carriage structures include soft bags and cases making shipment as checked baggage an assurance of resulting damage. Hand carrying is necessary for adequate protection, and maneuvering from airport to plane is extremely difficult. Shipment by another method is just as dangerous to the equipment as checked baggage. Movement of the shipping vehicle, especially a small vehicle, may cause the gear to be thrown about, damaging it, especially if the gear was difficult to position in the carrier.

Even if a boat operator does not travel with his boat, many boat operators will have occasion to permanently or temporarily store his or her boat at a marina or similar facility. Since most boat components are easily interchangeable with components of all other comparable boats, theft has historically been a problem; recovery of stolen boat components is difficult since components from boat to boat are very close in appearance and usually bear no distinguishing marks that might allow a boat operator to identify them as hers or his. Few options are available to boat operators who use marinas for temporary or permanent storage. One of the few options include a wall rack which may be used to store the sailboat's spars, and which may or may not be lockable. Even if wall racks are present in which to store a boat operator's spars, and even if they are lockable, the problem remains as to safe storage of smaller gear such as a rudder, tiller and the tiller extension, or dagger board, sail, lines, hardware, etc.

What is therefore needed is a lockable storage cover onto which all small boat gear may be strapped securely, stored and locked to protect from both damage and theft. What is further needed is flexibility in shipment—a structure which will allow safe, secure shipment when shipped either on or off of the boat.

SUMMARY OF THE INVENTION

The lockable storage cover of the present invention is designed for use with any small boat having a center cockpit in any situation where an operator has a need to secure and lock the boat gear, either for reasons of convenience or as a theft deterrent. The lockable storage cover of the present invention is designed so that each piece of smaller gear may be secured partially within and to one side of the storage cover with straps. After the gear is secured within the underside of the storage cover with straps which may partially or completely surround the storage cover, the storage cover is lowered partially into the cockpit opening of the boat. Structures are provided, which cooperate with the storage cover and within the cockpit of the water craft, to secure the storage cover to the watercraft in a way to transform the cockpit into a securely locked space into which further items may be securely stored. The structure which secures the storage cover to the cockpit also provides the ability to lock the resulting secured storage space to enable it to be left unattended or left better configured for shipping.

After other gear is stored in the cockpit, and after the cockpit is covered, the spars may be placed on specialized support structures on the upper side of the lockable storage cover. Whether or not the spars are present, the pair of lever action moveable arms lock the storage cover over the cockpit. If the spars are present they are also physically locked down onto the storage cover. The spar support structures keep the spars significantly elevated from the other portions of the water craft to reduce the possibility of contact with the boat's upper surface to preserve the boat's finish.

Two embodiments of a shipping enclosure for the storage cover are provided. One shipping storage cover matches the physical outside dimensions of the storage cover and is keyed to structures on the storage cover to form a protective sandwich. A second protective shipping cover is dimensioned to overlie the outside dimension of the storage cover of the invention to form at least a partial lid for the storage cover to provide protection during shipment and carriage. The lockable storage cover of the present invention is preferably made of molded plastic for durability, water resistance, low weight, and economy of production. The storage cover also allows a boat operator more freedom and more options when it is necessary to ship either the boat or the gear or both. The lockable storage cover of the present invention also allows a boat owner more freedom when operating his or her boat at a marina or similar facility, and it further provides a safe, secure configuration for storing and locking equipment for long periods of time.

BRIEF DESCRIPTION OF THE DRAWINGS

The invention, its configuration, and its construction will be further depicted in the following description, taken in conjunction with the accompanying drawings in which:

FIG. 3 illustrates a pair of lever arms which are in an open position and unlocked;

DETAILED DESCRIPTION OF THE DRAWINGS

Figures 1, 9, 10:
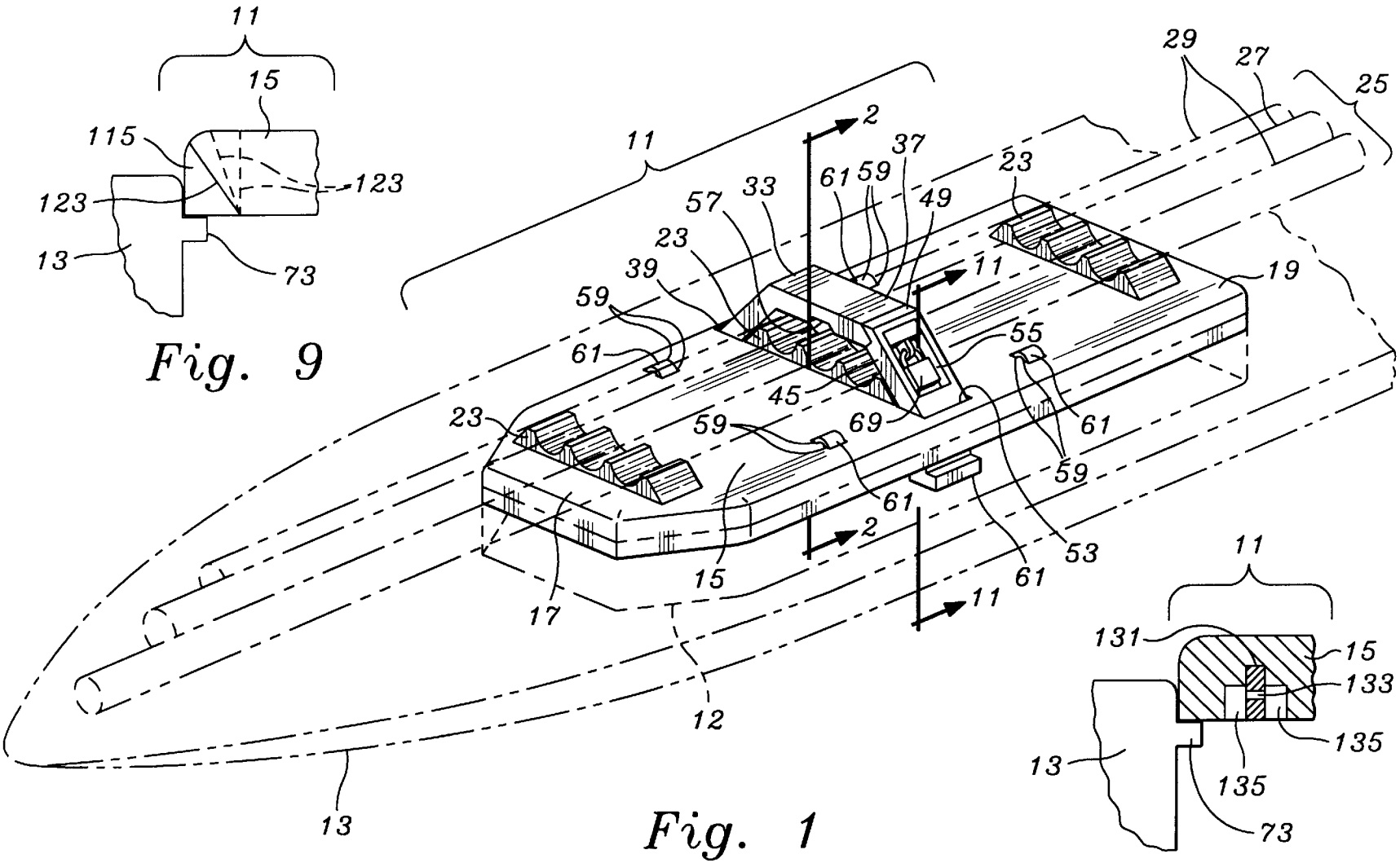
FIG. 1 is a top view of an embodiment of the lockable storage cover of the present invention in locked position and shown supported by a boat (illustrated in phantom) and supporting a set of spars (also illustrated in phantom) secured to the storage cover with a pair of lever arms which are in a closed position and locked.
FIG. 9 is a small partial end view of a small portion of an alternative version of the lockable storage cover, not otherwise shown which illustrates an alternate external strapping arrangement.
FIG. 10 is a cut away section view of the lockable storage cover of the present invention attached to a boat, similar to the view of FIG. 2 and is cross-sectional, which illustrates a second alternate strapping arrangement wherein a strapping bar is used within a cavity to provide strap support wholly on the underside of the storage cover.

FIG. 1 is a top perspective view of an embodiment of the lockable storage cover 11 of the present invention as attached to and lying partially within and over a generalized cockpit area 12. The cockpit area 12 may be larger or smaller than that shown, and a simple drop down area is shown for illustration purposes. The lockable storage cover 11 has a base structure 15 with straight sides which match, fit, cover, and sit partially within a cockpit opening, overlying a spatial cockpit area 12, of the boat 13. The cover 11 has a forward end 17 having a half-octagon shape, and a rear end 19 having sides which, in this instance, are squared off.

The base structure 15 is positioned slightly above the upper surface of the boat 13, but depending upon the geometry available, base structure may have an upper surface flush with the surface of the boat, or even below the boat 13 upper surface. On one side of the base structure 15 are three spar supports 23, which support a set of three spars 25 illustrated in phantom. Each portion of the spar support 23 which engages a spar has a cylindrical shape, and thus spar supports 23 have an upper surface having adjacent cylindrical sections of parallel axis. Note that the spar supports 23 may be embodied in a number of different ways to achieve the same results, including structures having lesser length, or a greater cylindrical extent. Alternatively, for example, the spar support 23 may be one elongate structure which runs the length of the lockable storage cover 11. Any geometry is acceptable provided that the spar supports 23 adequately support the set of spars 25. The set of spars 25, in this particular instance, consists of one larger spar 27 and two smaller spars 29.

Figure 2:
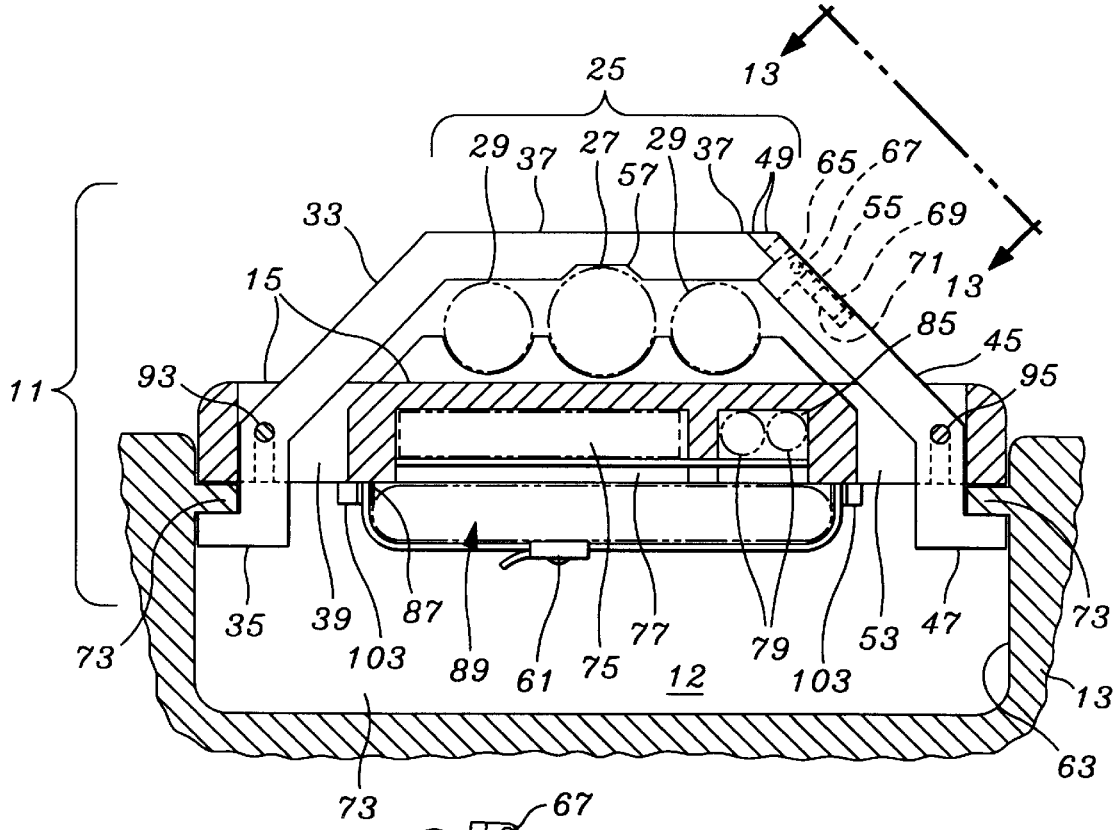
FIG. 2 is a cross-sectional view of the lockable storage cover of FIG. 1 taken along line 2—2 of FIG. 1 and which illustrates the lockable storage cover attached to a boat with pair of lever arms in a closed position and locked, and illustrating the spars, tiller, & tiller extension, rudder, and dagger board stored in their respective pockets within the lockable storage cover.

Referring to FIGS. 1 and 2, the lockable storage cover 11 has a first lever arm 33 with a first engagement end 35 below the base structure 15, and a second locking end 37. The first lever arm 33 extends through the base structure 15 in a first large aperture 39. The lockable storage cover 11 has a second lever arm 45 situated opposite the first lever arm 33 with a first engagement end 47 below the base structure 15 and a second locking end 49. The second lever arm 45 extends through a second large aperture 53 in the base structure 15. The second locking end 49 makes stable engagement with the second locking end 37 of the first lever arm. Note that first lever arm 33 and second lever arm 45 are different in length; note that it is possible to achieve satisfactory results with the first lever arm 33 equal in length to the second lever arm 45. Additionally, one of the arms may be fixed and one may be moveable, so long as one of the second locking ends 37 or 49 are joinable, and so long as one of the first engagement ends 35 and 47 is able to be moved into its locking position without the need for movement relative to the base structure 15. Second lever arm 45 contains an outwardly directed depression 55.

When the first and second lever arms 33 and 45 are locked together, the spars 25 are secured, whether or not the storage cover 11 is in place on the boat 13 or not.

Referring again to FIGS. 1 and 2, the first lever arm 33 and the second lever arm 45 in a closed and locked position. The first lever arm 33 has a wide, angled notch 57 on the surface adjacent the set of spars 25 so that the larger spar 27 is accommodated when it is placed in the middle spar support 23. If the first lever arm 33 and the second lever arm 45 were the same length, the angled notch 57 might be shared by both the first lever arm 33 and the second lever arm 45. When the first lever arm 33 and second lever arm 45 are closed together and locked, they exert sufficient locking pressure on the set of spars 25 such that the set of spars 25 are held in place between the first lever arm 33 the spar supports 23 supported by the base structure 15.

Figure 7:
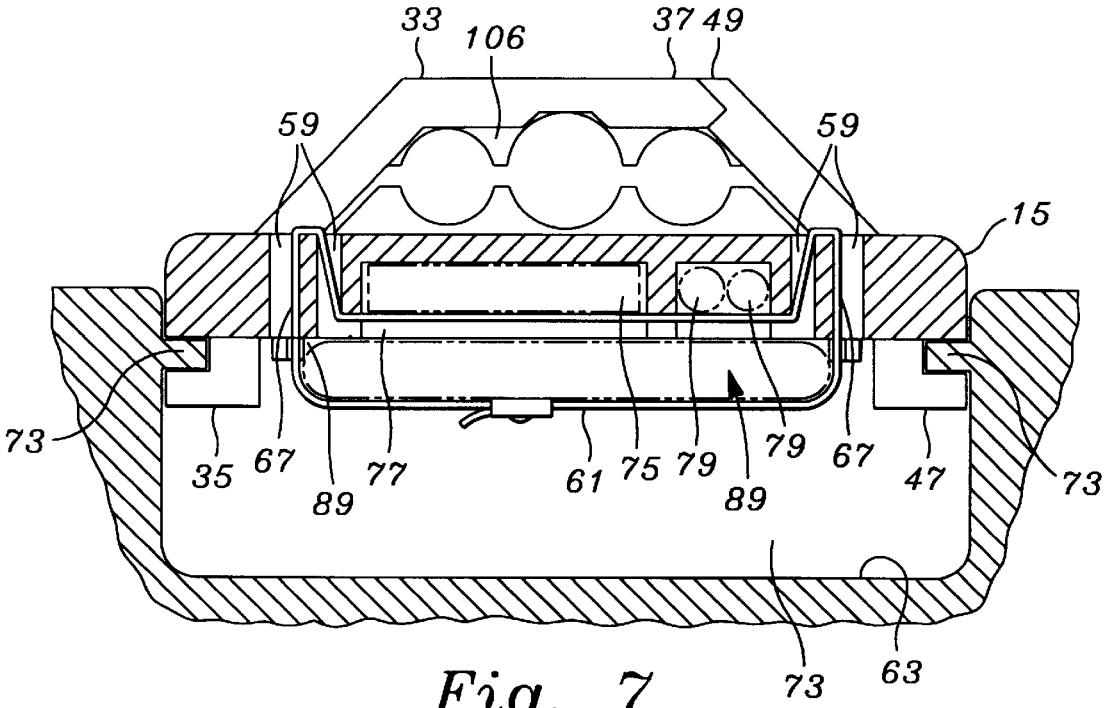
FIG. 7 is a view similar in orientation to that of FIGS. 2 and 4, but taken along line 7—7 of FIG. 3 which has a reference farther forward on the storage cover and to illustrate in detail the routing of the straps.

FIG. 1 illustrates the base structure 15 as having four pairs of small apertures 59, situated such that each pair is directly oppositely situated on the cover 11. A pair of straps 61 are shown threaded out of and back into adjacent ones of the pair of apertures, the straps 61 to secure the boat components to one side of the lockable storage cover 11. Note that these apertures 59 may be fewer or greater in number and may be situated in a number of different arrangements, so long as they adequately provide a strapping anchor from which to restrain the boat components. Details of each of the apertures are illustrated in FIG. 7, Wnd examples of alternate strapping structures are illustrated in FIGS. 9 and 10.

FIG. 2 is a cross-sectional view along line 2—2 of FIG. 1 which illustrates in greater detail the lockable storage cover 11 of the present invention as attached to a cockpit portion 63 of a boat 13. The cockpit portion 63 surrounds the cockpit area 12. Note that FIG. 2 clearly illustrates the position of the base structure 15 of the lockable storage cover 11 partially inside the cockpit portion 63 of the boat 13, and forming a generally conforming fit structure along all of the lockable storage cover's edges.

Figure 3:
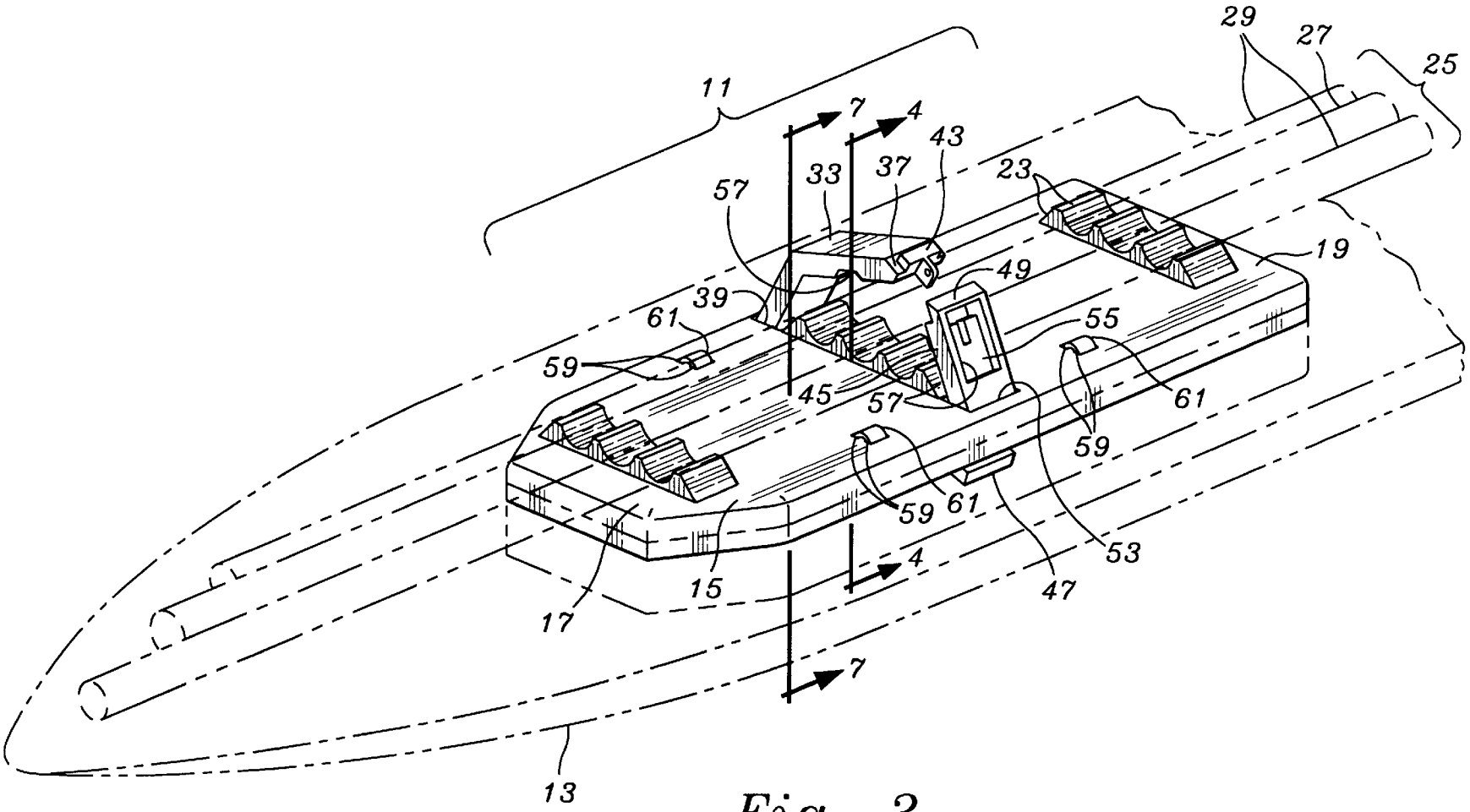
FIG. 3 is a top view of the lockable storage cover of the present invention as atop a boat (illustrated in phantom) and supporting a set of spars (illustrated in phantom) in a set of spar supports.

The locking structure of FIG. 2 will be best explained with reference also to FIG. 4. The second locking end 37 of the first lever arm 33 has an eyelet or tang structure 65 having a lock aperture 67 for engaging a lock 69. The tang structure 65 fits through a slot 71 in the second locking end 49 of the second lever arm 45. The slot 71 is angled to meet the tang structure 65. The geometry seen in FIG. 2, which is made more understandable with an immediate comparison to FIG. 3 provides for locking engagement, but without pressure on the bail of the lock 69. The lock 69 is recessed to help deter tampering, and this configuration also provides a geometry which will not bind the lock 69, leaving it free to rest within the outwardly disposed depression 55.

FIG. 2 illustrates spar supports 23, set of spars 25 including the larger spar 27 and two smaller spars 29 (in phantom), the first lever arm 33 in a closed position and having a first engagement end 35 locked into place under an inside inwardly disposed rib 73 of the cockpit portion 63 of the boat 13, and a second locking end 37 fitted into the second locking end 49 of the second lever arm 45. The second lever arm 45 is illustrated in a closed position with its first engagement end 47 locked into place under the inside of inwardly disposed rib 73 of the cockpit portion 63 of the boat 13; the depression 55 on the outer surface of the second lever arm 45 is illustrated in dashed line format. Further illustrated in FIG. 2 is a rudder 75 (illustrated in phantom) which is in a rudder compartment 77, and a tiller and tiller extension 79 (illustrated in phantom) in a tiller and tiller extension compartment 85 both on one side of the base structure 15. A dagger board storage space or compartment 87 is situated on the same side of the base structure 15 as the rudder compartment 77 and tiller and tiller extension compartment 85.

FIG. 2 illustrates (in phantom) a dagger board 89 in the dagger board compartment 87, covering the rudder compartment 77 and tiller and tiller extension compartment 85, as held in place by a pair of straps 61. Application of the straps 61 is as follows: beginning with any pair of small apertures 59 a strap 57 is inserted from the bottom of the base structure 15 through the outermost aperture, immediately back through the corresponding innermost aperture, over the rudder compartment 77 and the tiller and tiller extension compartment 85, securing the rudder 75, and tiller and tiller extension 79 within their respective compartments, and then back through the innermost aperture of the pair of small apertures 59 situated on the side of the base structure 15 immediately opposite the pair of small apertures 59 in which the strap 61 was initially threaded. The same procedure is repeated with a second strap 61 using the remaining two pair of small apertures 59. Next, the dagger board 89 is then placed into the dagger board compartment 87, covering the rudder 75, tiller and tiller extension 79. Then the pair of straps 61 are fastened together over the dagger board 89, securing all components located on that side of the base structure 15 in their respective compartments.

FIG. 2 illustrates a first pin 93 extending from the first lever arm 33 adjacent the first engagement end 35 and a second pin 95 through the second lever arm 45 and adjacent the first engagement end 47. Each of the first and second pins 93 and 95 fit into a pair of oppositely located and downwardly disposed pin cups (not shown-see FIG. 5) which serve as guides to facilitate the movement of the first lever arm 33 and second lever arm 45 into their locked positions, and which also serves to support the first lever arm 33 when it is used as a kickstand (see FIG. 8) for the lockable storage cover 11. The lockable storage cover 11 is preferably constructed of a molded plastic, for several reasons: such construction would allow quick and economical mass production, and would make the lockable storage cover 11 relatively lightweight, durable, and water resistant.

FIG. 3 is a top view of the lockable storage cover 11 of the present invention attached to the cockpit of the boat 13 of FIG. 1. FIG. 3 is identical to FIG. 1 in all aspects except that in FIG. 3, the first lever arm 33 is no longer in contact with the second lever arm 45, and both the first lever arm 33 and second lever arm 45 are in open positions. Note, also, that the first engagement end 47 of the second lever arm 45 is no longer locked into place under the inside of inwardly disposed rib 73 of the cockpit portion 63 in FIG. 3, since the second lever arm 45 is in an open position; the same is true of the first lever arm 33, better seen in FIG. 4. Numbering of all elements in FIG. 3 is identical to the numbering of elements in FIG. 1.

Figure 4:
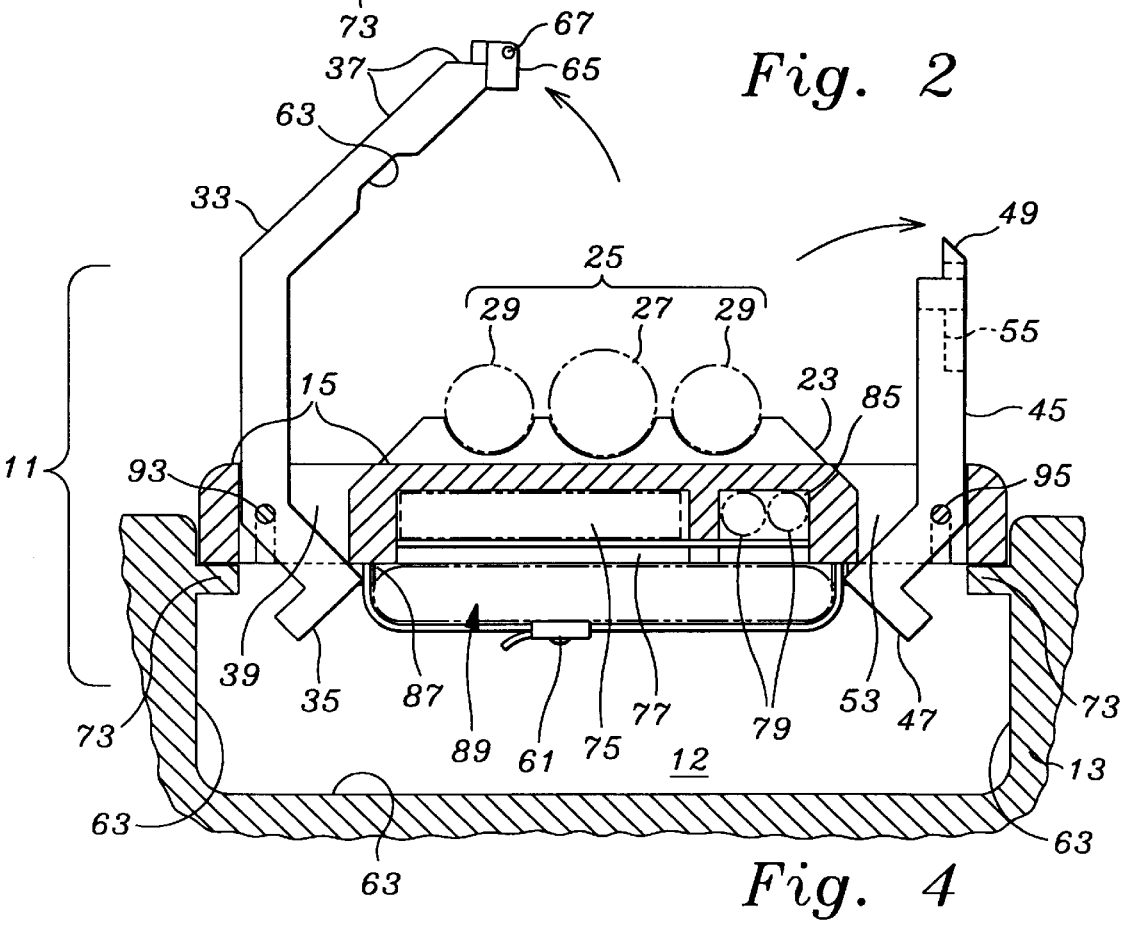
FIG. 4 is a cross-sectional view of the embodiment of the lockable storage cover of FIG. 3 taken along line 4—4 of FIG. 3 which illustrates the lockable storage cover atop a boat and shown with a pair of lever arms of the storage cover unlocked and in an open position, and illustrating in phantom the set of spars, tiller, tiller extension, rudder, and dagger board stored in their respective storage spaces in the lockable storage cover.

FIG. 4 is a cross-sectional view along line 4—4 of FIG. 3 which illustrates in greater detail the lockable storage cover 11 of the present invention as attached to the cockpit portion 63 of the boat 13 of FIG. 3. Note that FIG. 4 is identical to FIG. 2 in all aspects except that in FIG. 4, the first lever arm 33 is no longer in contact with the second lever arm 45, and both the first lever arm 33 and second lever arm 45 are in open positions. Note that when in open positions, the first engagement end 35 of the first lever arm 33 and the first engagement end of the second lever arm 45 are both disengaged from the inside of inwardly disposed rib 73 of the cockpit portion 63, allowing removal of the base structure 15 from the cockpit.

Figure 5:
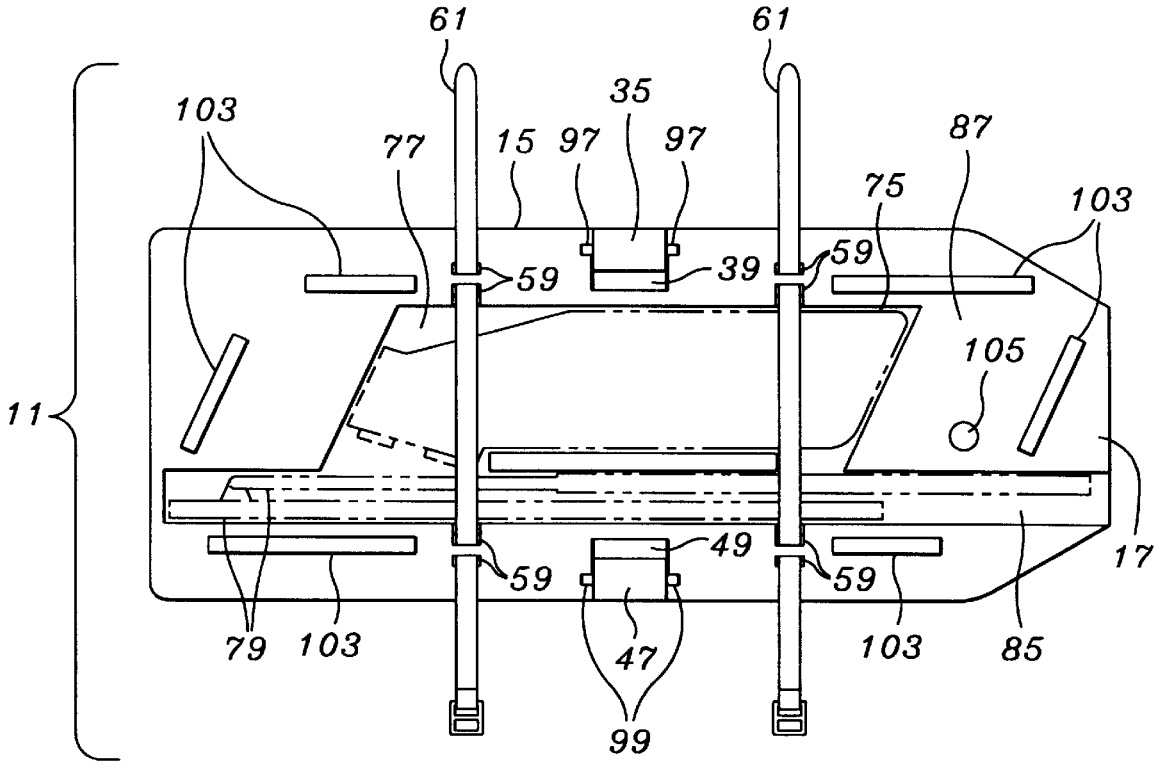
FIG. 5 is a view of one side of the lockable storage cover of the present invention having a tiller, tiller extension, and rudder stored in individual compartments and partially secured with a set of straps which also secure a dagger board (not shown) in the outermost compartment.

FIG. 5 is a view of the lockable storage cover of the present invention which illustrates the side opposite that shown in FIGS. 1 and 3. FIG. 5 illustrates in phantom the tiller and tiller extension 79 in the tiller and tiller extension compartment 85 and the rudder 75 in the rudder compartment 77. Note that the tiller and tiller extension compartment is open-ended at the forward end to accommodate oversized or longer tiller extensions. Such longer extension will likely extend into a forward compartment in communication with the cockpit area 63. FIG. 5 illustrates six locator structures 103 which are distributed around the tiller and tiller extension compartment 85 and the rudder compartment 77 and patterned to form a dagger board compartment 87. FIG. 5 also illustrates a cylindrical depression 105 on the same side of the base structure 15 as the rudder compartment 77 and the tiller and tiller extension compartment 85 at the forward end 17 adjacent to the tiller and tiller extension compartment 85 and within the bounds of the locator structures 103 which form the dagger board compartment 87. The purpose of the cylindrical depression 105 is to accommodate a cylindrical member of the dagger board 89 when it is stored in the dagger board compartment 87.

FIG. 5 better illustrates the position of the straps 61 threaded through each pair of small apertures 59 prior to the dagger board 89 being placed in the dagger board compartment 87. Referring also to FIG. 7, note that one side of the base structure 15, namely that side on which the rudder compartment 77 and tiller and tiller extension compartment 85 is located, the lateral apertures in each pair of small apertures 59 have openings which are planar with the base structure 15, and the medial, or inward most apertures in each pair of small apertures 59 have openings which are nearly planar with the bottom of both the rudder compartment 77 and tiller and tiller extension compartment 85, except for a slight elevation (see FIG. 7) between the plane of the rudder compartment 77 and tiller extension compartment 85. This enables more strap tension force to be applied to the structures being secured by straps 61.

FIG. 5 illustrates the first engagement end of the first lever arm 33 flanked by a first pair of pin cups 97 and the first engagement end of the second lever arm 45 flanked by a second pair of pin cups 99; both first lever arm 33 and second lever arm 45 are in a closed, locked position. Referring to FIG. 2, each of the first and second pins 93 and 95 rests in the first and second pair of pin cups 97 and 99, respectively, when the first lever arm 33 and second lever arm 45 are in any position.

Figure 6:
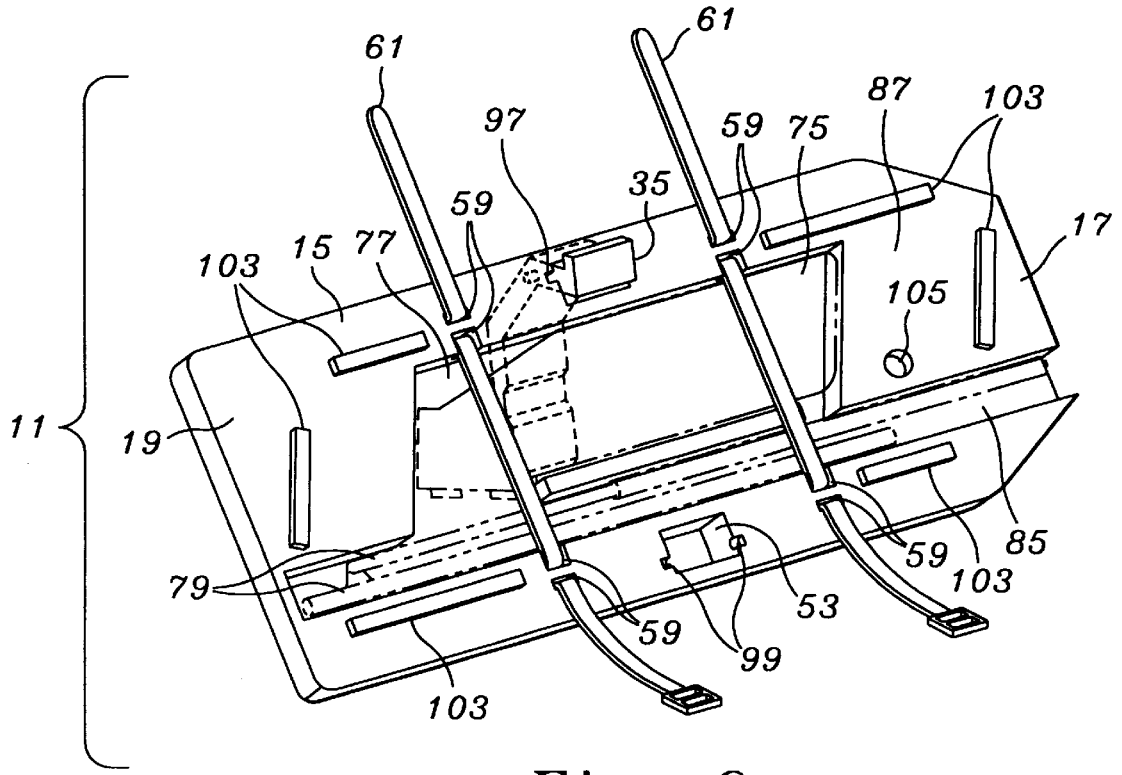
FIG. 6 is a view of the lockable storage cover of FIG. 5 which illustrates the lockable storage cover propped on its side with one of the lever arms in use as a supporting kickstand, to allow easy loading and unloading of the strapped in gear, and which omits illustration of the other of the lever arms.

FIG. 6 is view of the lockable storage cover 11 seen in FIG. 5 and illustrates the lockable storage cover 11 in a propped position with the first lever arm 33 used as a kickstand. FIG. 6 omits the second lever arm 45 in order to better illustrate the second large aperture 53, identical to the first large aperture 39, and through which the second lever arm 45 would normally extend. FIG. 6 also illustrates the second pair of pin cups 99 flanking the second large aperture 53, and one of the first pair of pin cups 97 flanking the first large aperture 39.

FIG. 7 is a view similar in orientation to that of FIGS. 2 and 4, but taken along line 7—7 of FIG. 3 in order to show the orientation of the stored gear and strap 61. As can be seen, the strap 61 makes a double path. The inside path extends between the innermost of the apertures 59 and across the rudder 75 and tiller 79, shown next to its extension. The outside path is continuous with respect to the inside path and extends between the outermost of the apertures 59 and across the dagger board 89. As can be seen, the path of the strap 61 shows that it is in tension evenly along its length. Alternate strapping structures and methods which are equally as effective as that illustrated here are illustrated in FIGS. 9 and 10.

Figure 8:
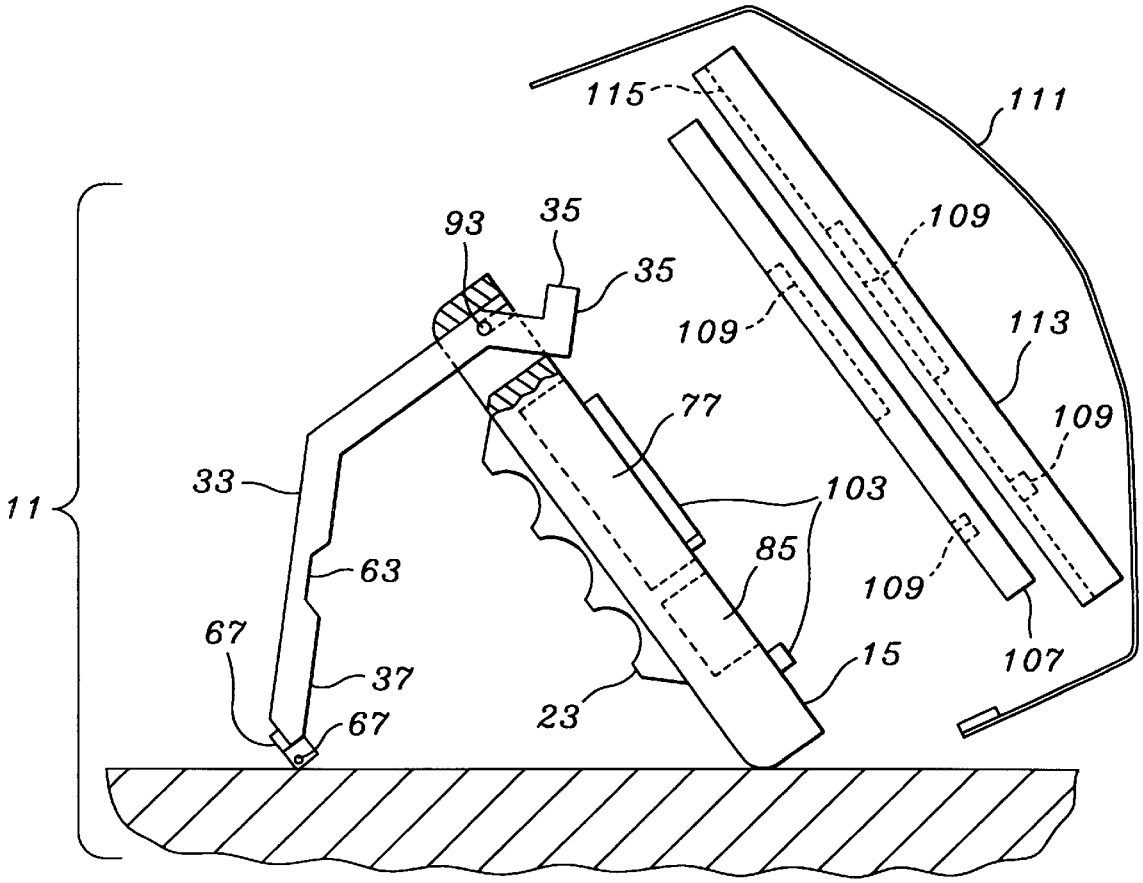
FIG. 8 is a side view of the propped lockable storage cover of FIG. 6 having one lever arm omitted for clarity, and illustrates a pair of separate shipping enclosures which are separately usable with the storage cover and including a first enclosure for even fit with the with the storage cover, and a second shipping enclosure for overfit with the storage cover.

FIG. 8 is a side view of the propped lockable storage cover of FIG. 6 having a the second lever arm 45 omitted for clarity, and illustrates the storage cover 11 in its kickstand position from which it may be more easily and safely loaded and unloaded. Note that the limits of travel of the first lever arm 33 determines the stability of the tilting orientation shown in FIG. 8. FIG. 9 also illustrates a pair of separate shipping enclosures, including a shipping enclosure 107 which is a board structure having key voids 109 which match the locator structures 103 seen on the lockable storage cover 11. The shipping enclosure 107 has outer dimensions matching those of the base structure 15 and relies upon outer straps 111 to hold shipping enclosure 107 to the base structure 15, the key voids 109 and the locator structures 103 serving to keep the enclosure from sliding in the planar direction with respect to the base structure 15.

Another shipping enclosure 113 is provided as an option. The outer dimensions of the shipping enclosure 113 are slightly larger than the dimensions of the base structure 15. The key voids 109 are present, but they are recessed behind a forward extending edge 115 which extends completely around the shipping enclosure 113, and when attached to the storage cover 11, will cover the facing outer edge of the storage cover 11. With the shipping enclosure 113, the strap 111 can also be used, as well as the possibility of other hold on structures, such as hasps, locks and the like. Either or both of the shipping enclosures 113 or 107 can provide notches or other structural accommodation for the engagement ends 35 and 47 of the lever arms 33 and 45 while the lever arms 33 and 45 are in place with respect to the base structure.

FIG. 9 is an end view of the lockable storage cover 11 of the present invention attached to a boat 13 and in contact with the inwardly disposed rib 73 of a cockpit portion 63. FIG. 9 illustrates a variation not seen in any of the other Figures, is similar to FIG. 2, but is not cross-sectional. FIG. 9 illustrates an alternate method of securing a strap 61 of FIGS. 5 & 6 to the lockable storage cover 11 which is a slot 123 for accommodating a strap. Slot 123 is shown in phantom as possibly having several angles which can range from about 40° from normal to being straight vertical. The slot 123 has side edges 125, between which the strap 61 will fit. In this configuration, a single strap 61 could be used to hold all of the gear in, which is not as preferable as the double strap method seen in FIGS. 1–8, but which could be acceptable in conjunction with the shipping enclosure 107 or 113, given the added force provided by the strap 111.

FIG. 10 is an end view of the lockable storage cover 11 of the present invention attached to a boat 13 and in contact with the inwardly disposed rib 73 of a cockpit portion 63. FIG. 10 is also similar to the view of FIG. 2 but is cross-sectional. FIG. 10 illustrates an alternate configuration for securing a strap 61 of FIGS. 5 & 6 to the lockable storage cover 11, but in which no part of the strap is exposed at the upper portion of the storage cover 11. This may be important where someone attempts to remove the storage cover 11 by cutting the straps 61, thinking that they serve as a release. In the configuration of FIG. 10, the straps will lie solely below the bottom surface of the cover 11.

A metal plate 131 having an elongate slot 133 is embedded into the base structure 15 as by injection molding or the like. The ends of the plate 131 facing toward and away from the observer of FIG. 10 extend beyond an opening 135 in which the center of the plate 131 resides. The strap 61 then passes into one side of the opening 135, through the slot 133 and back through the other side of the opening 135, and provides a strapping configuration similar to that seen in FIG. 7, but no part of the strap 61 is exposed above the upper surface of the base structure 15.

Figure 11:
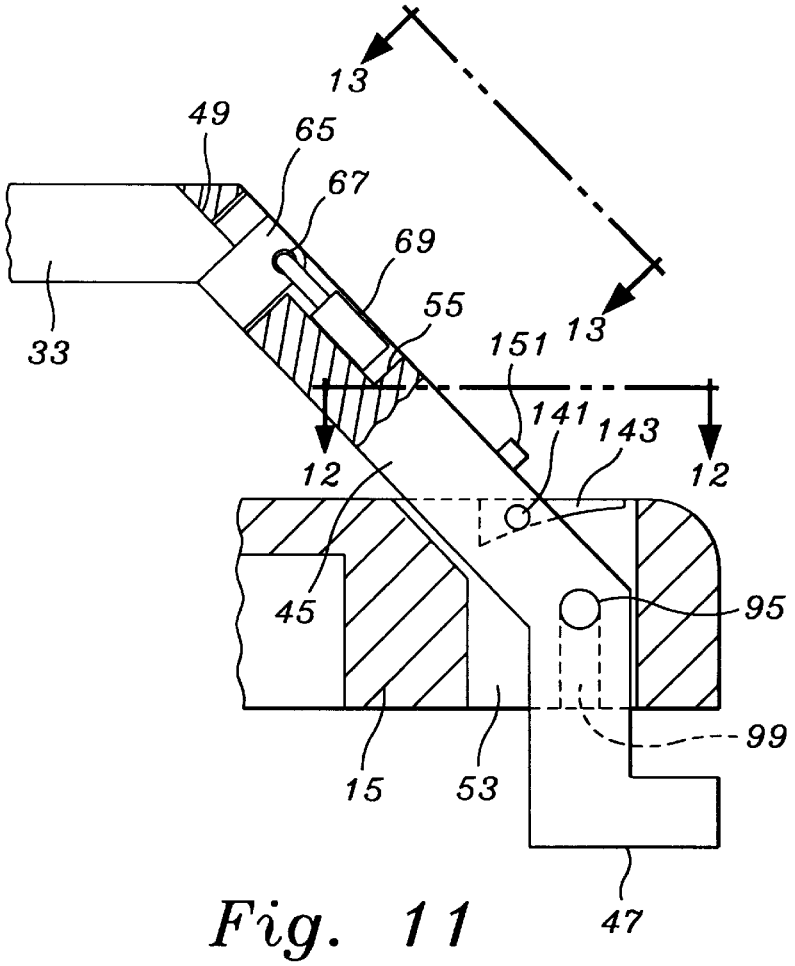
FIG. 11 is a sectional view taken through the center of the arm along line 11—11 of FIG. 1, but without the presence of the boat.

FIG. 11 is a sectional view taken through the center of the arm along line 11—11 of FIG. 1, and without the presence of the boat 13 in order to illustrate the manner in which the lever arms 33 and 45 are vertically supported, especially when they are in the vertical or open position. The method shown in FIG. 11 involves the use of a hemispherical projection on the front and back sides of the lever arms 33 and 35. It is contemplated that upon first insertion of the lever arms 33 and 35 upwardly and into the base structure 15 that there will be some mutual deformation of both the large apertures 39 & 53, and perhaps the lever arms 33 and 35, depending upon the material in which the are made. This detent action upon insertion is followed by controlled movement from providing a slot in which the partial hemispherical projections can travel.

Referring to FIG. 11, a partial hemispherical projection 141 is provided on both sides of the lever arm 45, one is seen facing the observer, and the other is located on the opposite side and facing in the opposite direction, directly behind the projection 141 seen. Projection 141 need not be hemispherical, other configurations and accommodations can be made to provide any similar type of guide and support pin, including a specialized slot in the large aperture 53 which dictates insertion of the lever arm 45 at an odd angle.

A slot 143 is provided for the path of travel of the projection 141 to help control the smooth displacement of the first engagement end 47. The bottom of the slot 143 is preferably, but need not always be radiused in order to enable a smooth path of travel which will not entail the lifting and lowering of the pins 95 within the pin cups 99. Vertical movement of the pins 95 would increase the wear on the projections 141, as well as other parts of the device.

Also seen in FIG. 11 is the angled surface of the base structure 15 and how it accommodates the lever arm 45 when the lever arm 45 is in its closed position. Also seen in FIG. 11 is the stop 151 which prevents movement through the aperture when the lever arm 45 is fully open.

Figure 12:
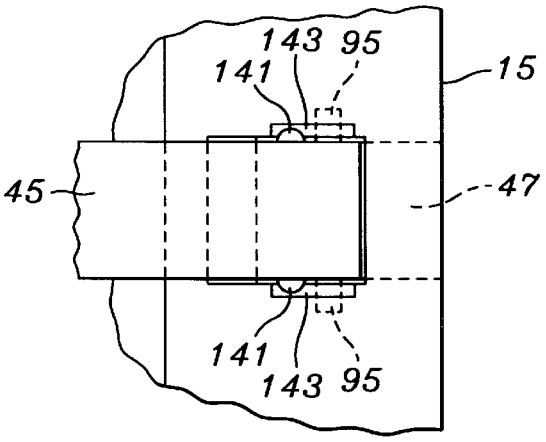
FIG. 12 is a top view looking down, and seen from line 12—12 of FIG. 11.

FIG. 12 is a top view looking down, and seen from line 12—12 of FIG. 11, and illustrates both projections 141 and the slots 143 in which they travel as the lever arm 45 is pivoted about the pins 95.

Figure 13:
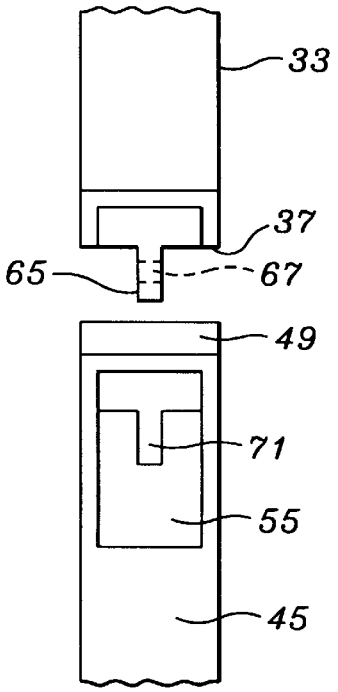
FIG. 13 is a view taken along line 13—13 of FIG. 11, but where the lock tang and slot are shown in exploded relation to illustrate the manner in which they interfit.

Referring to FIG. 13, a view taken along line 13—13, but where the lock tang and slot are shown in exploded relation to each other, illustrates the details of the interfitting of the tang 65 into the lock 67. As can be seen, the direction of removal of the tang from the slot 71 and the depression 55 is surface shown in the upward direction. This means that the lock 69 will not be forced upward to unwantedly expose the bottom of lock 69, especially if it is a key lock, to a position where it would collect water during a rain or be able to condense and collect condensed moisture. All of the structures associated with the area in common between the base structure 15 and lever arm 45 also applies to the structure between the base structure 15 and the lever arm 33.

There are several advantages seen in the embodiment of FIGS. 1–13 of using a pair of large apertures 39 and 53. First, when the cover 11 is manually carried by hand with or without the lever arms 33 and 45, the apertures 39 and 53 can be used as carrying handles. In addition, the use of the pins 93 and 95 permits the close control of the closure forces. The force generated from joining the lever arms 33 and 45, is contained within the pins 93 and 95 in their pin cups 97. This eliminates any clamping force on either the rib 73 or other inside portions of the cockpit portion 63 of boat 13. The structure holding the base structure 15 onto the boat 15 is the bottom side of the ribs 73. This is against the structure on the boat 13 which is best able to bear any force used to resist any attemtp to try to remove the storage cover 11 from the boat 13. Further, the design of the pin cups 97 and 99 being disposed downwardly provide good holding, even where the cover 11 and its attached spars are accidentally dropped. If dropped to contact the lever arms 33 and 45, the surfaces 149, and the compression against the spars provide adequate support. If dropped so that the engagement ends 35 or 47 hit the ground, the pin cups 97 and 99 provide adequate holding force, and are positioned to bear the brunt of such a drop.

Figure 14:
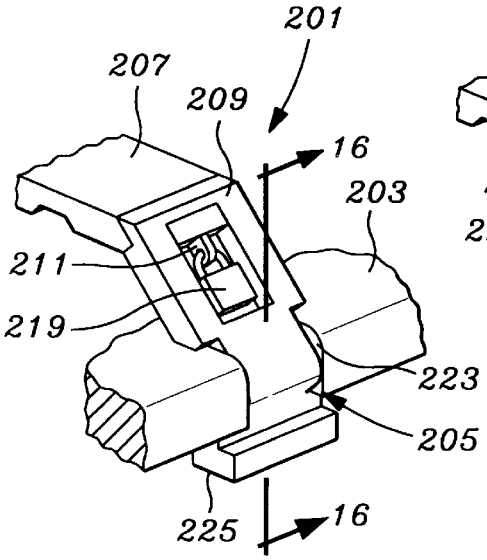
FIG. 14 is an alternative embodiment of the storage cover of the invention having side slots instead of apertures.
Figure 15:
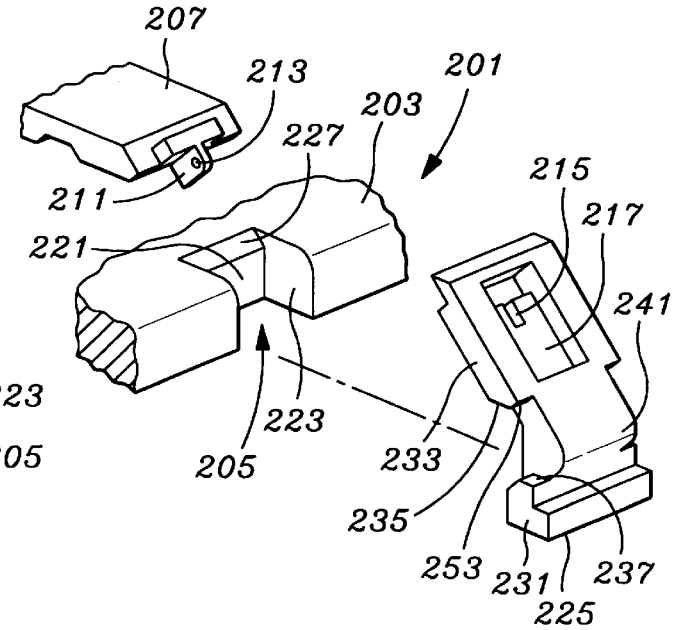
FIG. 15 is a partially exploded view as seen in FIG. 14 where one of the locking arms is displaced laterally to illustrate fit, the opposite locking arm having the same fit.

However, and referring to FIGS. 14 and 15, a second embodiment of the storage cover is provided as a storage cover 201 and in which the only detail shown will be the details concerning the design of the lever arms. Referring to FIG. 14, a base structure 203 is provided, only one side of which is shown. A large slot 205 occupies the space where the large aperture 53 was located, but with all of the material from what was the large aperture 53 to the outer edge of the base structure 15 removed, to form the base structure 203.

A first lever arm 207 engages a second lever arm 209 and has a tang 211 with an aperture 213 and engaging a slot 215, and provides a recess 217 for support and protection of a lock 219. The slot 205 has a back wall 221 and a pair of side walls 223. The lever arm 209 has an engagement end 225. However note that the lever arm 209 is wider than the slot 205 at points over the slot 205 and under the slot 205. Above the back wall 221, an angled portion 227 is seen.

The configuration dictates that the lever arm 209 must be inserted laterally into the end of the slot 205 and that it cannot be pulled vertically upward due to a wider bottom portion 231, nor pushed downward due to a wider top portion 233, both of which have some abutting surfaces, the top portion 233 having downwardly disposed surfaces 235 abutting the top surface of the base structure 203 and the bottom portion having upwardly directed surfaces 237 abutting the bottom surface of the base structure.

Now, if the upwardly directed surfaces 237 directly opposed the downwardly directed surfaces 237, the lever arm 209 could not pivot, but this is not the case. An upward projection of any one of the upwardly directed surfaces compared to a downward projection of its associated downwardly directed surface 237 would not only fail to have direct opposition, but there would preferably be a gap between the two projections, a vertical space in which there were neither an upward nor downward projection. This enables the lever arm 209 to pivot open and using the downward directed surface 237. In most cases, the pivoting will be due to the downward directed surface 237 pivoting or rolling against the opposing upper surface of the base structure 203.

Despite the horizontal offset of the surfaces 237 and 235, when the lever arms 207 and 209 are locked into place, the surface 237 is locked against the bottom surface of the base structure 203 while the surface 235 is locked against the top surface of the base structure 203. This gives many of the desired characteristics seen in the first embodiment of FIGS. 1–13, including lever arms which cannot be dislodged from their engagement with base structure 15 either by upward nor downward forces.

In addition, because a gap would normally otherwise exist between the outside of the lever arm 209 as it extends through the slot, and the cockpit portion 63 of the boat 13, an extended outer edge 241 is provided to partially fill this gap. This extended outer edge 241 should have a shape which will enable the lever arm 209 to roll or pivot to an open position, but which will not scratch or injure the inside of the cockpit portion 63.

Figure 16:
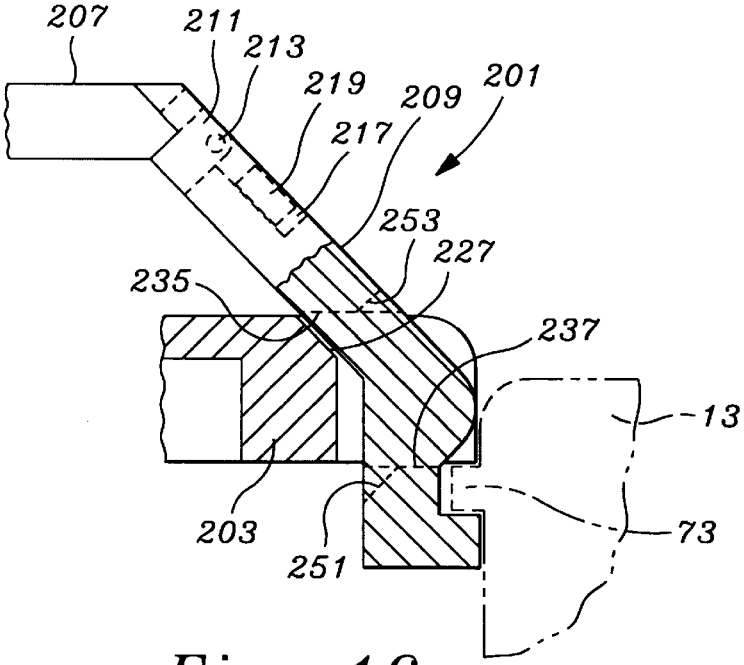
FIG. 16 is a sectional view taken along line 16—16 of FIG. 14 and illustrating the ability of the arm to open upwardly with respect to the storage cover.

Referring to FIG. 16, a sectional view taken along line 16—16 of FIG. 14 and illustrating the ability of the arm to open upwardly with respect to the storage cover is shown by illustrating the roll off surface 251 adjacent surface 237, and a roll off surface 253 adjacent the surface 235. The roll off surfaces 251 and 253 can, by virtue of their horizontal displacement and roll off curvature, control the opening and closing of the lever arms 209 and 207.

In both the embodiments of FIGS. 1–13 and FIGS. 14–16, the locking of the lever arms 33 and 45 or 207 and 209 form a stable configuration. When spars 25 are present, their removal after such lever arms are locked would be difficult, if not impossible, not only because of pressure exerted on the set of spars 25 by the first lever arm 33, and because brackets and pulleys (not illustrated) are normally present on each one of the set of spars 25 and would block removal from underneath the lever arms 33 and 45. The close form fit of the spar supports 23 further hinders movement of the set of spars 25 through the opening. Once the lockable storage cover 11 is in place over the cockpit of the boat 13, regardless of whether any one or more of the set of spars 25 is present, the cockpit becomes a storage locker in which other bulkier or larger equipment may be stored and safely locked away once the lockable storage cover 11 is in place.

However, when the spars are not present, or when one of them is not present, the lever arms 33 and 45 or 207 and 209 can be locked, in place with respect to the base structure 15 or 203, around a pole or other structure for secure safe keeping. Although it is desired to provide ample foam rubber backing on both the inside of the lever arms 33 and 45 or 207 and 209 and against the spar supports to gently and safely lock the spars 25, enough of a gap can be left to safely run a cable or small chain through the lever arms 33 and 45 or 207 and 209 to secure the spars 25 and cover 11 or cover 201 assembly to some other object.

The present invention may be used in any setting in which a lockable storage cover for a relatively small boat is needed. Multiple modifications to all embodiments of this invention are certainly possible with regard to the dimensions or arrangement of both the lockable storage cover and all elements thereon. For example, the spar supports may be varied such that there is only one support, but which runs nearly the length of the lockable storage cover; another variation might include evenly spaced spar supports which cover the entire side of the lockable storage cover. Another variation might be in the length and configuration of the lever arms 33 & 45; they may be equal in length, first shorter than second, second shorter than first, they may be angled or they may be curved. Variations are also possible with regard to composition of the lockable storage cover. Modifications to all parts of the invention may occur to those skilled in the art, and those modifications may be produced without departing from the spirit and scope of the invention. Therefore, included within the patent warranted hereon are all such changes and modifications as may reasonably and properly be included within the scope of this contribution to the art.

What is claimed:

1. A storage cover for a watercraft comprising:

a base structure having a pair of oppositely disposed sides, one of said sides having a spar support structure extending therefrom;

said base structure having a pair of lever arm apertures extending therebetween said pair of oppositely disposed sides;

a first lever arm having a first engagement end and a second locking end extendable through one of said lever arm apertures;

a second lever arm having a first engagement end and a second locking end extendable through the other one of said lever arm apertures and joinable with said second locking end of said first lever arm at one of said sides of said base structure.

2. The storage cover recited in claim 1 wherein said base structure has a strap aperture extending therethrough between said pair of oppositely disposed sides.

3. The storage cover recited in claim 1 wherein said base structure has a plurality of strap engagement structures on one of said pair of oppositely disposed sides.

4. The storage cover recited in claim 1 and further comprising a shipping enclosure having a size approximating the size of said storage cover and for fitting against one of said pair of oppositely disposed sides.

5. The storage cover recited in claim 4 and wherein said base stricture has a locator structure and wherein said shipping enclosure has key voids matching said locator structure to stabilize said shipping enclosure with respect to said storage cover when said shipping enclosure is attached onto said storage cover.

6. The storage cover recited in claim 4 and wherein said shipping enclosure has a forward extending edge which overlaps an edge of said base structure to assist in forming a stable structure with said base structure when said base structure and said shipping enclosure are brought together.

7. The storage cover recited in claim 1 and wherein said first engagement end of said first lever arm has one of a tang and a slot extending across the end of said first engagement end of said first lever arm, and wherein said first engagement end of said second lever arm has the other one of said a tang and a slot extending across the end of said first engagement end of said second lever arm, and engagable with said one of a tang and a slot.

8. The storage cover recited in claim 7 wherein one of said first and said second lever arms carries an outwardly disposed depression for containing and protecting a pad lock.

9. The storage cover recited in claim 1 wherein said base structure has a raised portion on one of said sides for containing a dagger board.

10. The storage cover recited in claim 1 wherein said base structure has a depression within an area bounded by a raised portion for containing a structure.

11. The storage cover recited in claim 1 wherein said first lever arm and said second lever arm each have at least one pivot pin and wherein said base structure includes a pin cup associated with each pivot pin and disposed toward one of said pair of oppositely disposed sides for pivotally engaging said at least one pivot pin.

12. The storage cover recited in claim 11 wherein each of said lever arms have a projection and wherein said base structure includes a slot for supporting a path of travel of said projection as said lever arm pivots about said at least one pivot pin.

13. A storage cover for a watercraft comprising:

a base structure having a pair of oppositely disposed sides and an aperture extending therebetween;

a first pivoting lever member having a first engagement end and a second locking end extendable through said aperture; and a second member having a first end and second locking end security lockable and joinable with said second locking end of said first lever member adjacent one of said pair of oppositely disposed sides.

14. A storage cover for a watercraft comprising:

a base structure having a pair of oppositely disposed sides and an aperture extending therebetween and wherein said base structure has a spar support structure extending from one of said pair of oppositely disposed sides;

a first lever member having a first engagement end and a second locking end extendable through said aperture; and a second member having a first end and second locking end joinable with said second locking end of said first lever member adjacent one of said pair of oppositely disposed sides.

15. A storage cover for a watercraft, comprising:

a base structure having a pair of oppositely disposed sides and an aperture extending therebetween and wherein said base structure has a strap support structure opening to one of said oppositely disposed sides;

a first lever member having a first engagement end and a second locking end extendable through said aperture; and a second member having a first end and second locking end joinable with said second locking end of said first lever member adjacent one of said pair of oppositely disposed sides.

16. The storage cover recited in claim 13 wherein said base structure has a compartment extending partially into one of said pair of oppositely disposed sides.

17. The storage cover recited in claim 16 wherein said compartment has a first opening on one side of said pair of oppositely disposed sides and a second opening on one side of said pair of oppositely disposed sides.

18. The storage cover recited in claim 13 wherein said base structure has a notch with a first end terminating on a planar surface between said pair of oppositely disposed sides, and a second end terminating on one of said oppositely disposed sides.

19. A storage cover for a watercraft comprising:

a base structure having a pair of oppositely disposed sides and a slot extending into said pair of oppositely disposed sides;

a first lever member having a first engagement end, an upper portion wider than said slot and a lower portion wider than said slot and fittable into and pivotable with respect to said slot, and having a second locking end;

a second member having a first end and second locking end security lockable and joinable with said second locking end of said first lever member adjacent one of said pair of oppositely disposed sides.

* * * * *